United States Patent [19]

Gregg

[11] Patent Number: 4,477,941

[45] Date of Patent: Oct. 23, 1984

[54] SPRING LOADED LUGGAGE CASE HINGE

[75] Inventor: James S. Gregg, Aurora, Colo.

[73] Assignee: Samsonite Corporation, Denver, Colo.

[21] Appl. No.: 338,043

[22] Filed: Jan. 8, 1982

[51] Int. Cl.[3] ..... E05D 11/06

[52] U.S. Cl. ..... 16/289; 16/291; 16/296; 16/354; 16/376; 16/DIG. 36; 220/335; 220/342

[58] Field of Search ..... 16/257, 284, 286, 289, 16/291, 293, 296, 303, 354, 363, 374, 376, 386, DIG. 36; 220/335, 338, 342; 217/58

[56] References Cited

U.S. PATENT DOCUMENTS

| | | | |
|---|---|---|---|
| 2,067,042 | 1/1937 | Bloom | 16/354 |
| 2,141,449 | 12/1938 | Rathbun | 16/262 X |
| 2,244,168 | 6/1941 | Miller | 16/291 X |
| 2,319,346 | 5/1943 | Rathbun | 220/335 |
| 2,379,254 | 6/1945 | Rathbun | 220/342 X |
| 3,092,870 | 6/1963 | Baer | 16/354 X |
| 3,132,911 | 5/1964 | Heidler | 16/289 X |
| 3,402,422 | 9/1968 | Baer | 16/354 X |

*Primary Examiner*—Fred A. Silverberg
*Attorney, Agent, or Firm*—George J. Netter

[57] ABSTRACT

A lower edge wall of a luggage case part has camming teeth with intervening grooves. The other case part has a set of spaced apart teeth for consecutive meshing with those of the first case part. One or more leaf springs are received across the meshed teeth of the case parts. The dimensions and geometry of the spring are such that when the case parts reach a predetermined maximum opening angle, the central spring portions contact opposing portions of the two case parts forming a limit stop to further opening of the case.

1 Claim, 5 Drawing Figures

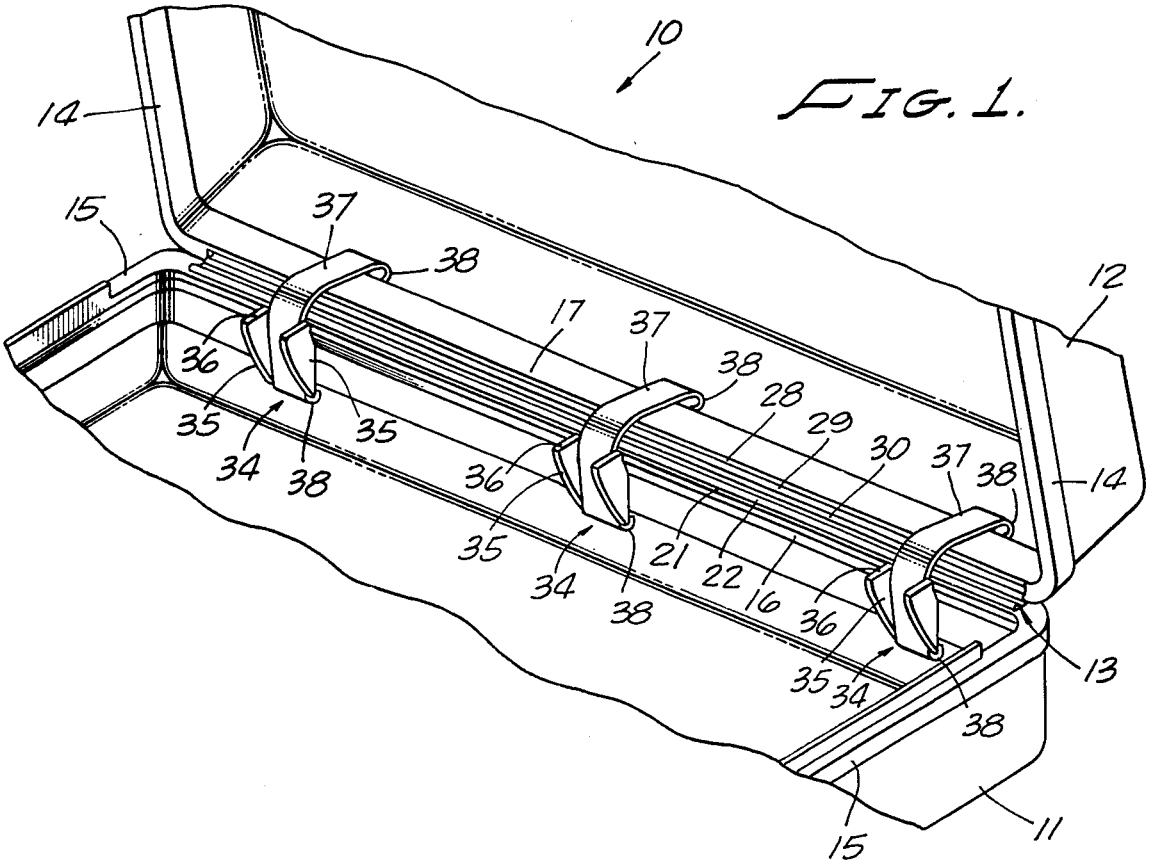
FIG. 1.
FIG. 2.
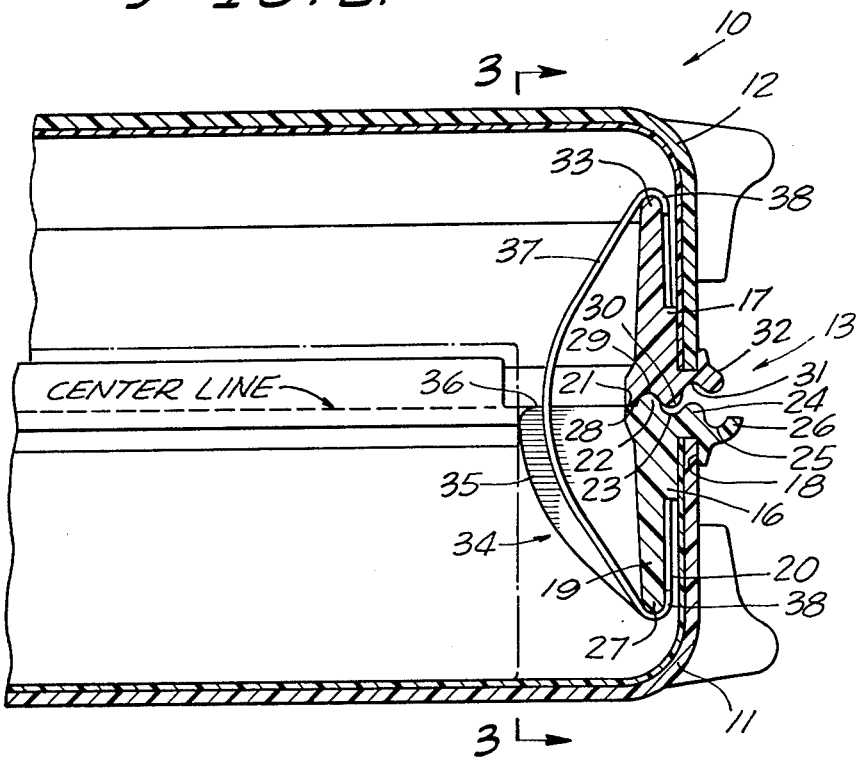

FIG. 4.
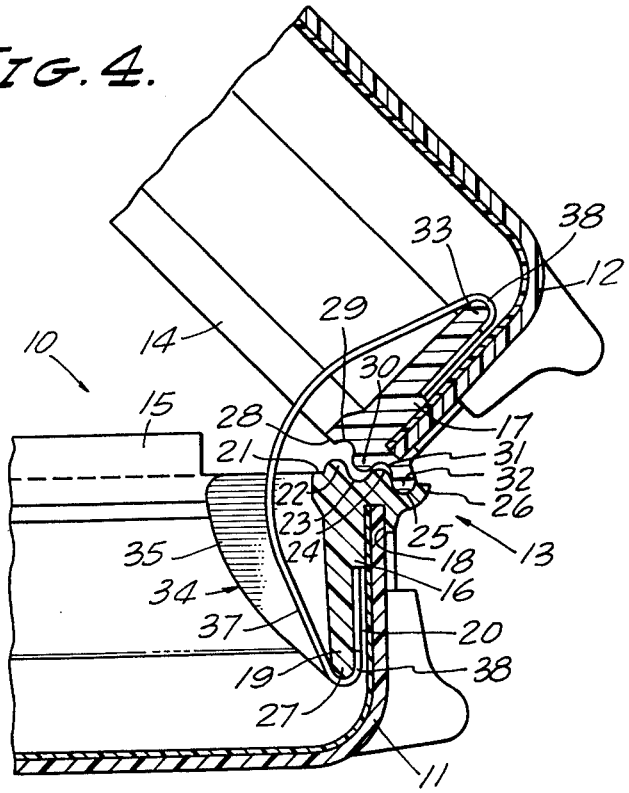
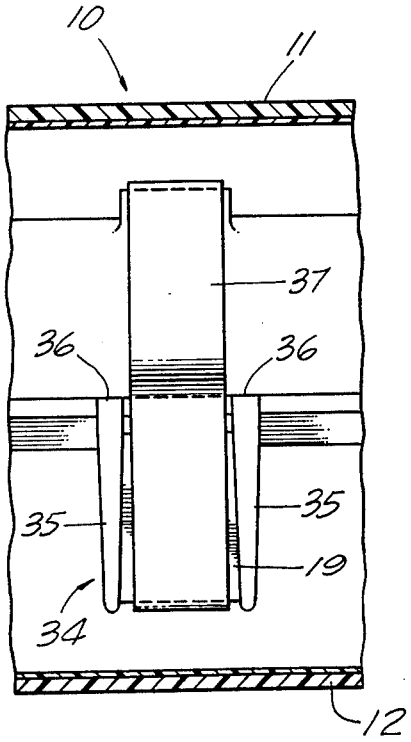
FIG. 3.
FIG. 5.
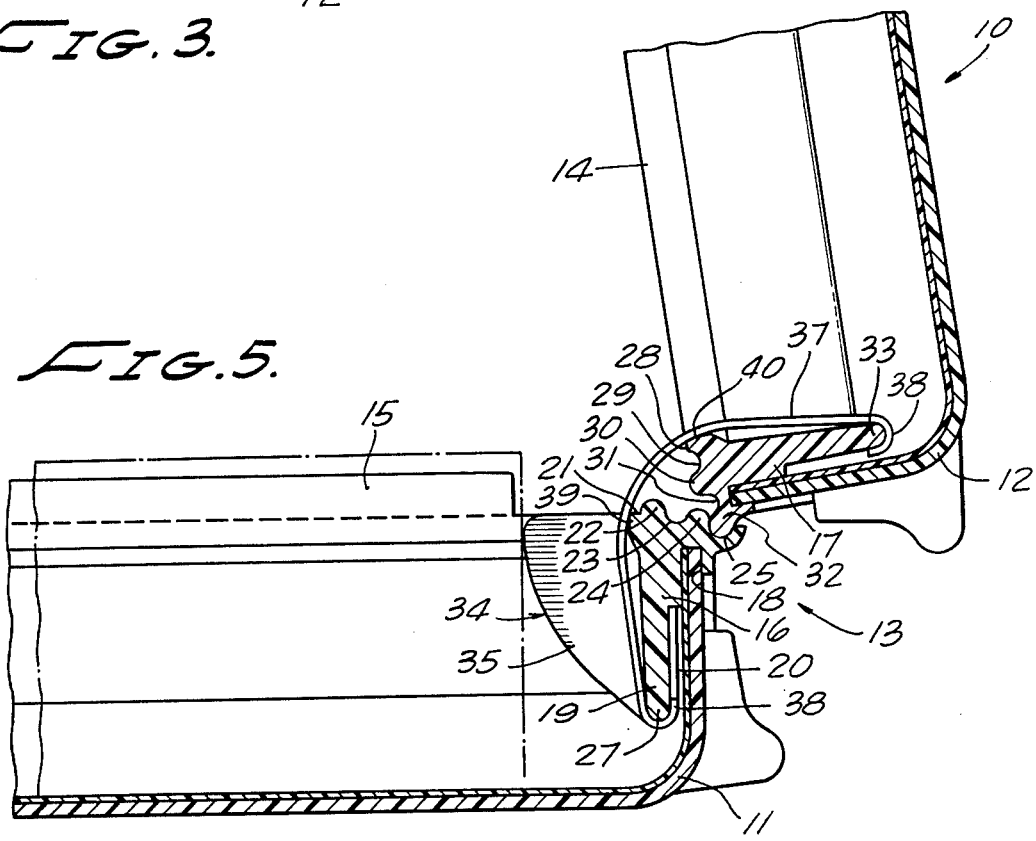

SPRING LOADED LUGGAGE CASE HINGE

The present invention relates generally to a luggage case hinge and, more particularly, to an improved hinge which is integrally formed with the luggage case frame.

BACKGROUND OF THE INVENTION

Luggage cases, and particularly those of the so-called attache case variety for containing business papers and the like, desirably include means for maintaining the case parts in open or fixed angular relationship to each other so that the contents may be removed or materials placed into the case without the inconvenience of having the case parts close on one another. In the past, this has most often been accomplished by braces or knee-action stays located at one or both sides of the case, which not only take up space, but on closing of the case can pinch fingers of the user, or tear or crease papers contained therein.

Also, in a usual form for such braces, stops or catches are provided which when engaged hold the case parts at some maximum open position, but if the parts are located at some lesser angular relation the case lid is relatively unsupported and can fall into the closed position with obvious undesirable effects.

Still further, such braces can, if the case becomes overloaded or the contents shift to one side or the other, on closing become broken or distorted to the point that they are inoperable.

SUMMARY OF THE INVENTION

A luggage case with which this invention may be advantageously employed includes two shell-like parts or halves dimensioned for receipt onto one another to define a containing space. A frame for each of the luggage parts includes along a lower wall interfitting parts which mesh together. More particularly, the lower edge wall on the frame of one of the luggage case parts has a plurality of camming teeth with intervening grooves. The other case part wall includes a similar set of spaced teeth with grooves therebetween dimensioned to mesh rollingly with those of the first case part. With the case parts closed on each other, one tooth of one case part is received within a mating groove of the opposite case part. As the case shells open with respect to one another, there is a consecutive meshing of the teeth and grooves of the one case part with those of the other case part whereby rotation of the case parts with respect to each other is along a non-circular path.

One or more arcuate leaf springs having their ends formed into hooklike members are snapped onto receiving parts of the frame along the hinge edge. The leaf spring serves to resiliently secure the luggage case shells together in the hinge area when the case is closed and throughout the full extent of the opening of the case. The curve of the leaf spring is such that when the case reaches an ultimate predetermined opening angle of, say, 90 degrees, the central portions of the spring move into contact with opposing portions of the shell frames in the hinge area serving as a limit stop to further opening of the case. The spring also serves to secure the case parts together when closed and when a certain predetermined angular relationship of opening is achieved to resiliently urge the case parts to the fully open position and hold them there.

DESCRIPTION OF THE DRAWINGS

FIG. 1 is a perspective, partially fragmentary view of an open luggage case showing the hinge described herein.

FIG. 2 is an end elevational, sectional view taken through the hinge.

FIG. 3 is a side elevational, sectional view taken along the line 3—3 in FIG. 2.

FIGS. 4 and 5 are views similar to FIG. 2 showing the luggage case partially open and fully open, respectively.

DESCRIPTION OF A PREFERRED EMBODIMENT

Turning now to the drawings, and particularly FIG. 1 thereof, a luggage case of the kind with which the present invention is considered to be especially advantageous is depicted partially fragmentary and enumerated generally as at 10. The case includes first and second conventionally formed shell-like case parts or halves 11 and 12 which are rotatably interconnected about a hinge edge 13 in a manner to be described. Although not considered limitative in this regard, the luggage case may be a so-called attache case for containing business papers and the like having the shells 11 and 12 formed of plastic moldings each secured, respectively, at its edge margins to a frame 14 and 15 which may be constructed of metal or plastic, as desired. Typically, a carrying handle and latch mechanism are located on the edge opposite hinge edge 13 (not shown).

Turning now simultaneously to FIG. 2, the hinge is seen to consist of first and second hinge parts 16 and 17, respectively, which are formed integrally with the luggage case frame in the case hinge edge. More particularly, the first hinge part 16 includes an elongated slot 18 for receipt onto the molded case shell edge 11 and to which it is secured in a conventional manner. The innermost portion 19 of the hinge part is formed into a plate-like member separated by a space 20 between the part and the shell wall 11. Just outwardly of the edge of the case wall 11, the hinge part 16 is formed in a way that will now be described into a series of elongated rounded camming teeth and separating slots or grooves somewhat similar to gear teeth for cooperative action with a further set of complementary teeth on the hinge part 17.

Still referring to FIG. 2, the surface of the hinge part 16 that faces the other hinge part 17, includes at its innermost a narrow, flat band 21 lying on the centerline between the two case shells when closed. Immediately adjacent this flat surface 21 is a raised circularly curved tooth or bead 22 which extends throughout the full length of the hinge part. Next adjacent the tooth 22 is a smoothly curved slot or groove 23 also extending the full length of the hinge part. Moving farther toward the outside of the case, next to the groove 23 is another tooth 24 extending the full length of the part, and again next to it is a further groove or slot 25 of circular cross-section, and finally the part terminates in a lip 26 which partially closes in the side of the groove 25. It is important to note that a line through the high points of the two teeth 22, 24 and the lip 26 extends downwardly and outwardly to the outside of the case from the centerline of the case part 11 and 12. More particularly, the teeth 22, 24 and grooves 23, 25 are circularly curved with the radius center points having their locus on a circle the center of which is the point 27 immediately adjacent the innermost hinge portion 19.

The other hinge part 17 is constructed substantially identically to the first described hinge part 16 except for the toothed portion. That is, the hinge part is slotted for receipt onto the case part 12 edge, and includes an inner platelike portion spaced from the case shell. The toothed portion, however, is constructed to be complementary to the set of teeth and grooves 22–26 already described. Accordingly, as shown in FIG. 2, the innermost portion of the toothed region includes a flat surface 28 which when the case is closed abuts against the flat surface 21, and immediately adjacent thereto is an elongated curved slot 29 which fits closely onto the tooth 22. With the case still closed as in FIG. 2, it is seen that on moving away from slot 29, in the order described, there is a further tooth 30, a slot 31, and a final tooth 32. The grooves 29, 31 and teeth 30, 32 are circularly curved with their centers lying on a further circle the center of which is the point 33 adjacent the end of the innermost hinge portion. Thus, when the case parts are closed, only the tooth 22 is seated within slot 29, while the remaining teeth and slots of each hinge part are spaced from the complementary parts on the opposite hinge part.

At spaced intervals along the hinge part 16 there are located paired protection means 34 for a purpose to be described later herein (FIG. 1). More particularly, each such means 34 includes first and second upstanding walls 35 unitarily related to the hinge part and spaced from each other along the part. When viewed along the hinge, the walls have a flat edge 36 which is coplanar with the centerline of the case shells and tapers away from this edge toward the hinge part.

An arcuate leaf spring 37 is located between each set of protection means walls 35 and includes hooklike ends 38 for receipt onto the respective edges of the hinge platelike portions 19 (FIG. 2). The geometry and dimensions of the springs are such that they will resiliently urge the teeth and grooves of the hinge parts 16 and 17 toward mutual engagement of each other throughout all angular relations of the case shells 11, 12 to each other. The protection means walls 35 extend inwardly within the containing space of the luggage case a sufficient amount that the leaf spring 37 is protected throughout the full range of movement of the case parts, from contact within the case contents.

For the ensuing description of hinge operation, reference is made to FIGS. 2, 4, and 5 showing the hinge when the two case shells are closed on each other, partway open and fully open, respectively. Beginning with the case closed as in FIG. 2, the very first opening movement is a rotative sliding of tooth 22 within groove 29 which continues until tooth 30 bottoms out in groove 23. Further rotation of tooth 30 within groove 23 serves both to remove the tooth 22 from its receiving groove and finally to move tooth 24 into groove 31. Lastly, further rotation brings tooth 32 into groove 25 and continues until a limit stop to additional opening rotation is brought about by the central concave portions of spring 37 contacting both hinge parts as at 39 and 40 (FIG. 5).

By virtue of the described construction, on moving the two case shells from the closed position to fully open position, the hinge parts 16 and 17 successively rotate about different axes of the hinge. More particularly, as the case opens the various axes of rotation are formed by cooperative action, in the order named, of tooth 22 in groove 29, tooth 30 in groove 23, tooth 24 in groove 31, and lastly tooth 32 in groove 25.

For a full understanding of the advantages accruing to the described hinge, a detailed presentation of the hinge operation, particularly in regard to the loading effected by spring 37, will now be given. As the luggage case parts move from the closed condition to a predetermined point where the parts are approximately half opened, the distance between the hinge points 27 and 33 remains constant and, therefore, the spring force is constant throughout this same range. On further movement past the predetermined middle point until the case is fully open, the distance between points 27 and 33 shortens and since the hinge parts 16 and 17 are arranged at a substantial angle to each other, the spring force acts to urge the case into the open condition. Both of the spring conditions are desirable, in that when the case is first opened the case parts should not merely fall apart allowing the contents to come out. Also, spring loading the case to the open condition allows access to the contents without having inadvertent closing that could result in pinching of the fingers or damage to the contents.

In the practice of the present invention there is provided a hinge for pivotally interrelating a pair of wall members arranged in edge opposed condition. Each of the opposed edges has what in effect are camming means with a plurality of elongated raised beads or rounded teeth extending throughout a substantial length of the respective opposed edge and generally parallel thereto. Between adjacent beads there is an elongated groove. These two camming means fit together and can be rotated about each other, with rotation being consecutive about multiple axes. Spring means for urging the camming means toward and into contact with each other include one or more (three are shown) curved leaf springs, the concave portion of each spring facing toward the camming means. Hooked ends of the spring facilitate spring attachment.

The luggage case hinge described here offers distinct advantages in ease of manufacturability. Thus, whereas conventional hinges require rivets or screws and additional labor devoted to mounting the various parts onto the case, the present hinge parts 16 and 17 are integrally formed with the case frame. Accordingly, mechanical assembly of the case halves together consists merely of snapping the spring 35 in place. Moreover, although the spring and spring protection means are depicted as exposed in FIG. 1, it is contemplated that a suitable covering will be placed thereover.

I claim:

1. Luggage hinge for interconnecting first and second opposed edges of first and second luggage case halves, respectively, such that the case halves may pivot about the opposed edged between a closed position and an open position, comprising;

a first hinge part affixed to the first opposed edge of the first case half having on one end a plurality of teeth with intervening grooves facing the second opposed edge of the second case half, said teeth and grooves being elongate and extending along generally parallel to the first opposed edge;

a second hinge part affixed to the second opposed edge of the second case half having on one end a plurality of teeth with intervening grooves which are dimensioned to mesh consecutively with the teeth and intervening grooves of the first hinge part;

only a first tooth of one of said first and second case halves meshing and in abutment with a first groove of another of said first and second case halves when the case halves are closed on each other, and consecutive meshing and abutment of other teeth and grooves occurring as the case halves are opening and thereby moving said hinge parts along a curved path, wherein only one tooth and one groove are meshing and in abutment at a time;

at least one generally C-shaped leaf spring having a central concave portion and with its ends secured to the first and second hinge parts on an end opposite to said one end to resiliently urge the hinge parts together, said first tooth and said first groove being spaced and in abutment with the central concave portion of the spring to provide two spaced stops with only a last tooth of said one of said case halves and a last groove of said another of said case halves meshing and in abutment when the case halves are in the open position, said spring thereby serving as a positive limit stop, said spring exerting at a predetermined constant force throughout movement of the luggage case halves from the closed position to a predetermined midway position, and between the predetermined midway position and the open position the spring exerts another constant force; and one of the case halves includes a pair of spaced upstanding walls, one at each side of the leaf spring.

* * * * *